US005324027A

United States Patent [19]

Nye

[11] Patent Number: 5,324,027

[45] Date of Patent: * Jun. 28, 1994

[54] METHOD AND APPARATUS FOR ADJUSTING A BASKETBALL GOAL

[75] Inventor: Stephen F. Nye, Roy, Utah

[73] Assignee: Lifetime Products, Inc., Clearfield, Utah

[ * ] Notice: The portion of the term of this patent subsequent to Nov. 1, 2005 has been disclaimed.

[21] Appl. No.: 474,637

[22] Filed: Jan. 30, 1992

Related U.S. Application Data

[63] Continuation of Ser. No. 267,498, Nov. 4, 1988, abandoned, which is a continuation of Ser. No. 157,898, Feb. 2, 1988, Pat. No. 4,805,901, which is a continuation-in-part of Ser. No. 922,041, Oct. 21, 1986, Pat. No. 4,781,375.

[51] Int. Cl.[5] ..... A63B 63/08

[52] U.S. Cl. ..... 273/1.5 R; 248/281.1

[58] Field of Search ..... 273/1.5 R, 1.5 A; 248/281.1, 284, 642; 211/99; 49/356; 294/19.1; 297/28, 29, 27, 356, 359

[56] References Cited

U.S. PATENT DOCUMENTS

| | | | |
|---|---|---|---|
| Re. 13,239 | 5/1911 | Undemeyer | 49/356 X |
| 169,382 | 11/1875 | Starr | 248/281.1 |

(List continued on next page.)

FOREIGN PATENT DOCUMENTS

| | | | |
|---|---|---|---|
| 876190 | 6/1953 | Fed. Rep. of Germany . | |
| 326491 | 5/1935 | Italy | 297/28 |
| 4737 | of 1907 | United Kingdom | 49/356 |
| 194024 | 3/1923 | United Kingdom | 271/99 |
| 908055 | 10/1962 | United Kingdom | 273/1.5 R |

OTHER PUBLICATIONS

Catalog of Diversified Products, "25 Years of Innovation", (date of publication not known), pp. 61-72.

American Playworld, "Sure Shot Instructions", Ogden, Utah (date unknown).

Basketball Survey Center, Owner's Manual—Easy-Adjuster Adjustable Basketball Pole (date unknown). Photographs.

Huffy Sports, Form Letter, May 22, 1987.

Lifetime Products, "Quick Adjust" Advertisement, (date of publication unknown).

Lifetime Products, Assembly Instruction Sheet of Quick Adjust Mechanism, (date of publication unknown).

Lifetime Products, Quick Adjust Sketch, (date of publication unknown).

Huffy Sports, Huffy Elevator Advertisement, Waukesha, Wis., (date of publication unknown).

Huffy Sports, "Basketball's Hottest Products this Year", Waukesha, Wis., (date of publication unknown).

*Primary Examiner*—Paul E. Shapiro

*Attorney, Agent, or Firm*—Madson & Metcalf

[57] ABSTRACT

An apparatus for adjusting the height of a basketball goal. A basketball goal is pivotally connected to a rigid vertical support by two parallel support members thereby forming a parallelogrammatic structure. A support arm containing a slot with a plurality of notches is pivotally connected to one of the vertexes of the parallelogrammatic structure while the opposite end of the support arm slidably engages a post attached to the parallelogrammatic structure. The notches are configured such that when a notch engages the post, the parallelogrammatic structure is locked in position. The method of the present invention allows a user equipped with a pole and standing on the basketball playing surface to apply a force to the goal thereby forcing the notch to disengage the post and allowing the parallelogrammatic structure to deform such that the user may raise the goal and engage the locking mechanism upon the release of the force. By applying a force directly to the support arm, a user may disengage the locking mechanism and move the goal to any of several predetermined heights. When the goal has been placed at the desired height, the force is released thereby engaging the locking mechanism and preventing further deformation of the parallelogrammatic structure.

17 Claims, 3 Drawing Sheets

U.S. PATENT DOCUMENTS

| | | | |
|---|---|---|---|
| 171,746 | 12/1875 | Starr . | |
| 214,549 | 4/1879 | Bruen | 248/336 |
| 214,618 | 4/1879 | Bruen | 248/336 |
| 306,188 | 10/1884 | Strong | 294/19.1 X |
| 334,243 | 1/1886 | Lang et al. | 248/335 |
| 466,464 | 1/1892 | Hood et al. | 248/281.1 |
| 627,516 | 6/1899 | Morgan | 248/407 |
| 750,956 | 2/1904 | Essig | 294/19.1 X |
| 806,790 | 12/1905 | Foersterling | 248/281.1 |
| 964,394 | 7/1910 | Coddington | 248/407 X |
| 1,090,291 | 3/1914 | Engelhart | 294/19.1 X |
| 1,189,044 | 6/1916 | Boden | 248/333 |
| 2,313,188 | 3/1943 | Woodburn | 273/1.5 |
| 3,017,183 | 1/1962 | Chalcroft | 273/1.5 |
| 3,376,068 | 4/1968 | Walkinshaw | 297/437 |
| 3,427,025 | 2/1969 | Procter | 273/1.5 |
| 3,469,870 | 9/1969 | Barkus | 287/58 |
| 3,544,110 | 12/1970 | Dickinson | 273/1.5 |
| 3,586,324 | 6/1971 | Bearson | 273/1.5 R |
| 3,765,676 | 10/1973 | Bearson et al. | 273/1.5 R |
| 3,802,702 | 4/1974 | Pulley | 273/1.5 R |
| 4,145,044 | 3/1979 | Wilson et al. | 273/1.5 R |
| 4,151,989 | 5/1979 | Dittrich | 273/1.5 A |
| 4,330,101 | 5/1982 | Andersen | 248/284 |
| 4,395,040 | 7/1983 | White | 273/1.5 R |
| 4,412,679 | 11/1983 | Mahoney et al. | 273/1.5 R |
| 4,465,277 | 8/1984 | Dittrich | 273/1.5 A |
| 4,684,129 | 8/1987 | Andersen et al. | 273/1.5 R |
| 4,784,432 | 11/1988 | Brown | 297/28 |
| 4,798,381 | 1/1989 | Dadbeh | 273/1.5 R |

METHOD AND APPARATUS FOR ADJUSTING A BASKETBALL GOAL

This application is a continuation of U.S. application Ser. No. 07/267,498, filed Nov. 4, 1988, now abandoned; which is in turn a continuation of Ser. No. 07/157,898, filed Feb. 2, 1988 (now U.S. Pat. No. 4,805,901); which was a continuation-in-part of Ser. No. 922,041, filed Oct. 21, 1986 (now U.S. Pat. No. 4,781,375).

BACKGROUND

1. Field of the Invention

The present invention relates to a method and apparatus for adjusting the height of a basketball goal.

2. The Background of the Invention

Because of the popularity of the sport of basketball, particularly in the United States, many people, especially families, mount a basketball goal on their property. This allows them to have ready access to a basketball goal to enjoy the sport of basketball.

Children, however, frequently find it frustrating to learn how to play basketball because the standard height of a basketball goal is ten feet and it is often difficult for children to throw the basketball that high. Thus, many families with small children find it desirable to install a basketball goal at a height which is much lower than the standard height. Indeed, families with many small children may be forced to sacrifice having a basketball goal at the standard height, which is suitable for adults, so that the children may more easily develop their basketball skills and more fully enjoy the game.

Although many small children have the ability to throw the basketball through the goal, this is usually only accomplished by exerting extreme effort, often at the expense of proper form. Many people never develop proper shooting form because, as small children, they developed an incorrect form because that was the only way they could throw the basketball high enough to reach the basket. Hence, another advantage of having a basketball goal at a lower height is that smaller children may learn proper basketball skills and practice shooting the basketball with correct form. Thus, the child does not have to relearn skills as he becomes stronger.

It will be appreciated by anyone with a knowledge of the sport of basketball that one of the most envied abilities associated with the sport is the ability to "dunk" the basketball. One dunks the basketball by throwing the basketball into the basketball goal from a position above the rim of the goal. Obviously, one must be extremely tall and/or possess an extraordinary leaping ability in order to position himself high enough to be able to dunk the basketball.

While many people are able to develop excellent basketball skills, it will be appreciated that very few people have the natural leaping ability and/or height to be able to dunk the basketball. So that one may be able to develop skills and practice different styles of dunking the basketball, it is often desirable to place the basketball goal at a height somewhat lower than the standard height. However, it is not usually practical to permanently mount a basketball goal at a lower height simply for the purpose of dunking the basketball. It is also not practical to have two basketball goals, one at the standard height and one at a lower height. Hence, most basketball goals are simply mounted at the standard height.

Because of the reasons mentioned above, many attempts have been made to design a basketball goal which is adjustable to several different heights. One design of an adjustable basketball goal employs a flexible cable and a pulley which can be operated to raise or lower the goal to the desired height. The goal is then affixed at that height by tying off the cable. Disadvantages to this type of design are that adjustment is very slow and the cable often experiences a short life span because of its constant exposure to the weather. Thus, because of the extreme amount of tension placed on the cable when the basketball goal is being used, especially when one dunks the basketball or hangs on the rim of the basketball goal, the cable could break. As the cable continually becomes weaker due to its constant exposure to a variety of weather conditions, the amount of tension required to break the cable gradually decreases until the actions of someone playing basketball are enough to cause the cable to break. When the cable does break, the break is usually caused by the actions of people using the goal. These people are endangered, and serious injury or death could result if they are in the path of the goal when the cable breaks should the goal fall to its lowest position.

Another design for an adjustable goal employs pivotally mounted parallel bars which connect the basketball backboard to a rigid mounting device such as a pole. The parallel bars combine with the basketball backboard and the rigid mounting device to form a parallelogram. Since the bars are pivotally mounted, they allow the backboard of the basketball goal to move to several different heights while remaining vertically disposed. Typically, once the basketball goal is at the desired height, it is secured in place by tightening one or more bolts which "lock" the parallelogram in place.

One of the disadvantages of this device is that whenever one desires to adjust the basketball goal, it requires the use of a ladder or similar device to enable one to reach the one or more bolts which must be loosened to "unlock" the basketball goal. This is complicated by the fact that when the bolt or bolts are loosened, the person adjusting the goal must support the entire weight of the goal until the goal has been set to the desired height and the bolt or bolts are tightened again. This can be both a strenuous and a dangerous task and may be impossible physically for many small children to perform. This is an unfortunate disadvantage because it is usually small children who have the greatest need for lowering the basketball goal. Yet another significant disadvantage of this type of design is that if the bolt or bolts become loosened through vibration or other means while the basketball goal is in use, the goal will fall to its lowest position, striking whomever may be in its path.

Yet another design for an adjustable basketball goal employs the same parallelogrammatic structure as the previously discussed design except a telescoping ratchet mechanism is employed, rather than a bolt or bolts, to secure the basketball goal in the desired position. As the goal is raised, a hinged pawl on one member engages a row of apertures in a second telescoping member, seriatim in a ratchet-like fashion. The configuration of the pawl permits the goal to be raised by applying an upward force to the basketball backboard, but the pawl will engage one of the apertures preventing downward movement if the upward force is removed. When the desired height is reached, the upward force is released and the pawl engages the aperture to which it is aligned preventing the goal from falling due to its own weight.

From any of the intermediate height positions, the goal can be raised to a higher position, but it cannot be lowered to a lower position without neutralizing the pawl because the pawl will engage the nearest aperture preventing downward movement. To neutralize the pawl, the goal must be raised to its highest position, a position higher than the highest usable level for the goal, where the pawl engages an ear which cocks the pawl into a neutral position. With the pawl so neutralized, the basketball goal may be lowered because the pawl will not engage any apertures during the descent of the goal. As the goal reaches its lowest position, the pawl engages another ear which releases or trips the pawl back to its original, active position where it may again engage any of the apertures and secure the goal at the desired height.

One disadvantage of this design is that because of its complexity, it is both difficult and expensive to manufacture. Additionally, because basketball goals are often used outdoors and exposed to extreme weather conditions, its design requires frequent maintenance to ensure that the goal always works properly while reducing the risk that the locking mechanism will fail.

That the pawl is neutralized at the extreme uppermost position gives rise to another significant and possibly dangerous disadvantage. If, when the goal is at its highest usable level, a person dunks the basketball and momentarily hangs on the rim of the basket, the entire goal will spring upwardly upon release of the rim. If this upward force is substantial, the goal may spring upwardly causing the pawl to strike the ear which cocks the pawl into the neutral position. Neutralizing the pawl permits the basketball goal to crash to its lowest position, possibly causing serious injury or death to persons involved in the basketball game.

In order to reduce the danger in the potentially dangerous crashing of the basketball goal, a fluid cylinder has been used to prevent the basketball goal from rapidly falling when the pawl is neutralized. However, the fluid cylinder introduces a delay into the time it takes the basketball goal to be adjusted to the desired height because the assent and descent speed is retarded by the fluid cylinder. Additionally, the fluid cylinder does not prevent the pawl from being cocked into its neutral position under the conditions just described, nor does it obviate the necessity of having to readjust the height of the basketball goal when the pawl is neutralized and the basketball goal descends to its lowest height. Further, because the fluid cylinder is a separate accessory from the ratchet mechanism, the user may choose not to install it or the user may remove it if it becomes damaged or broken.

As an added precaution to reduce the potential for injury, a safety locking mechanism employing a tightening bolt has also been used to rigidly secure the height of the goal having adjustability provided by the ratchet mechanism described above. However, the basketball goal is often used without tightening the bolt to lock the ratchet mechanism in place because tightening the bolt would require employing a ladder to enable the user to reach the bolt. Furthermore, the bolt typically is at a height higher than the rim of the basket; hence, the higher the basketball goal is placed, the less likelihood there is that the user of the goal will be able to reach the bolt in order to secure the goal. Consequently, when the goal is at the standard height of ten feet, the bolt is positioned over ten feet high. Thus, the locking mechanism is least likely to be employed when the basketball goal is set at the highest usable level. It is at this level that it is critical to employ the locking mechanism to prevent the pawl from becoming neutralized inadvertently and the basketball goal from crashing to its lowest position.

It will be appreciated, therefore, that what is needed in the art are methods and apparatus for adjusting the height of a basketball goal which are easy and economical to manufacture, do not pose a danger to those who may use the device, are easily adjustable from one height to another without employing a ladder or similar device, and are durable and able to withstand constant exposure to a variety of weather conditions.

BRIEF SUMMARY AND OBJECTS OF THE INVENTION

The present invention includes novel methods and apparatus for adjusting a basketball goal. The invention uses a parallelogrammatic structure to facilitate the adjustability of the basketball goal. The present invention has an adjustable support brace comprising two parallel arms which can be used to selectively secure the parallelogrammatic structure whereby a person of any height, without the use of a ladder or similar device, may adjust the height of the basketball goal. Further, the present invention does not permit the basketball goal to crash to its lowest position either when the basketball goal is in use or when it is being adjusted.

The apparatus of the present invention utilizes a deformable parallelogrammatic structure comprising upper and lower support members pivotally mounted at one end to a vertically disposed rigid support, such as a pole or a wall, and at the other end to a mounting plate upon which a basketball backboard may be mounted. The parallelogrammatic structure is deformable in that each vertex for the structure is a pivot joint which allows the structure to change its shape while maintaining the characteristics of a parallelogram. Because of the nature of a parallelogram, the mounting plate upon which the upper and lower support members are pivotally mounted maintains a vertical disposition as it moves through an arc from its lowest position to its highest position as a consequence of the rigid support opposite the mounting plate being vertically disposed. In this manner, the basketball goal may be affixed to the mounting plate and the mounting plate will maintain the backboard vertical and the rim horizontal as the goal is adjusted up and down as desired.

The mounting plate is securely disposed in a selected position by means of an adjustable support brace which comprises two parallel arms. One end of the support brace is pivotally mounted to the parallelogrammatic structure, preferably at the vertex nearest the basketball rim. At the other end of the support brace, each of the parallel arms contains a longitudinal slot. The slot has several notches, each disposed in spaced relationship to the others along one side of the slot. A post is firmly mounted to the upper support member of the parallelogrammatic structure and disposed within the slot of each of the parallel arms. Thus, as the shape of the parallelogrammatic structure is altered, thereby changing the distance between the post and the vertex at which the support brace is pivotally mounted, the slot may slidably engage the post to permit such deformation of the parallelogrammatic structure. The notches are configured to engage the post and thereby secure the support brace from movement within the slot when a downward force (such as gravity) is applied at the mounting plate, while permitting release from the notch and movement within the slot when a sufficient upward force is applied at the mounting plate. Because of the angle at which the support brace is mounted, the force of gravity acts on the system to actuate the support brace such that whenever the post is aligned with a notch, gravity will urge the system so that the post engages the notch. The side of the slot opposite the notches is a sawtooth configuration which aids to guide the post into the notch with which it is aligned. In this manner, the post will not release from the notch within which it is disposed and allow the basketball goal to crash down to its lowest position. The support brace is disengaged from the post by either applying a sufficient upward force at the mounting plate or by pivoting the support brace about its axis at the vertex of the parallelogrammatic structure.

The support brace is pivoted about its axis by applying an upward force to the support brace. When such a force is applied, the support brace pivots about its axis at the vertex of the parallelogrammatic structure such that the notch is removed from its engaged connection with the post and is disposed within the slot, at which point the shape of the parallelogrammatic structure may be altered to adjust the height of the basketball goal. When the basketball goal is at the desired height, the support brace may be permitted to pivot under the force of gravity such that the post engages the notch aligned with the post in resting engagement and thereby "locks" the parallelogrammatic structure in place.

In raising the basketball goal to a selected height from among various predetermined heights, a long rod or similar implement is placed in a guide loop which is located near the mounting plate. The guide merely serves to provide a place close to the mounting plate where an upward force may be applied without the rod slipping. After placing the rod in the guide, a force sufficient to raise the goal is applied to the goal via the rod. The side of the slot which has the notches remains forced against the post under the force of gravity. Thus, as the goal is raised, the post acts against the bevelled side of the notch with which it is engaged and, in doing so, imparts a slight pivoting motion to the support brace. When the goal is raised to the position where the next notch is aligned with the post, the support brace, acting under the biasing force of gravity, immediately pivots about its axis to engage the post with the notch with which it is now aligned. Consequently, as each notch is encountered, the post engages the notch and the goal will rest at the predetermined height corresponding to that notch. As a continued upward force is applied, the post will disengage the notch within which it is resting and then advance to the next notch and each successive notch until the desired height is obtained.

When it is desired to lower the height of the basketball goal, the rod may be used to depress a release cup located on the support brace. Depressing the release cup forces the support brace to rotate about its axis such that the post disengages the notch with which it is aligned and moves to a point in the slot, allowing the goal to freely move up or down while the post slides along the slot. The goal may then be lowered to its lowest position. The rod is then removed from the release cup and placed in the guide loop and the procedure described above is followed to raise the goal to the desired height.

If, while lowering the basketball goal, the rod should inadvertently slip, thereby rapidly removing the depressing force from the release cup, the sawtooth configuration in the slot opposite the notches, in combination with the force of gravity, will act to pivot the support arm such that the first notch which comes into alignment with the post will engage the post. As the post is engaged, no further downward movement of the basketball goal occurs thereby preventing the goal from crashing to its lowest position.

The support brace is disposed such that the release cup is shielded by the parallelogrammatic structure. This prevents an errant basketball from depressing the release cup during normal play. Even if the release cup were to be inadvertently hit with a foreign object, the release cup is only momentarily depressed and the basketball goal will drop, if at all, only one position. It should be noted, however, that it is highly unlikely that the release cup could be inadvertently depressed with sufficient force to cause the notch to become disengaged from the post and result in the goal falling to the next lowest position.

It is, therefore, a primary object of the present invention to provide an apparatus for adjusting a basketball goal in such a way that the support arm does not become completely disengaged when a force is applied to the basketball goal and then suddenly released, such as is often the case when the basketball is dunked.

It is a further object of the present invention to provide such methods and apparatus so that the basketball goal may be adjusted from one level to the next without having to perform complicated maneuvers.

It is an additional object of the present invention to provide an apparatus wherein normal use of the basketball goal will not cause the adjustable telescopic support to become disengaged resulting in the basketball goal falling to its lowest position.

It is a further object of the present invention to provide such methods and apparatus wherein the basketball goal may be adjusted without the use of a ladder or similar device.

Another object of the present invention is to provide an apparatus for adjusting the height of a basketball goal that is durable and resistant to a variety of changing weather conditions.

Still another object of the present invention is to provide an adjustable basketball goal that is easily adjustable and poses no danger to those who are adjusting the basketball goal or those who are playing basketball with the goal.

It is an additional object of the present invention to provide an adjustable basketball goal which comprises few moving parts and is easy and economical to manufacture.

Other objects of the present invention may become apparent by reference to the drawings, the detailed description of the invention and the claims set forth herein.

DETAILED DESCRIPTION OF THE PREFERRED EMBODIMENTS

The present invention is directed to an apparatus for adjusting the height at which a basketball goal is set. The apparatus is designed to enable a person to quickly and safely adjust the height of a basketball goal, and to prevent the inadvertent and undesirable crashing of the goal down to its lowest height.

Figure 1:
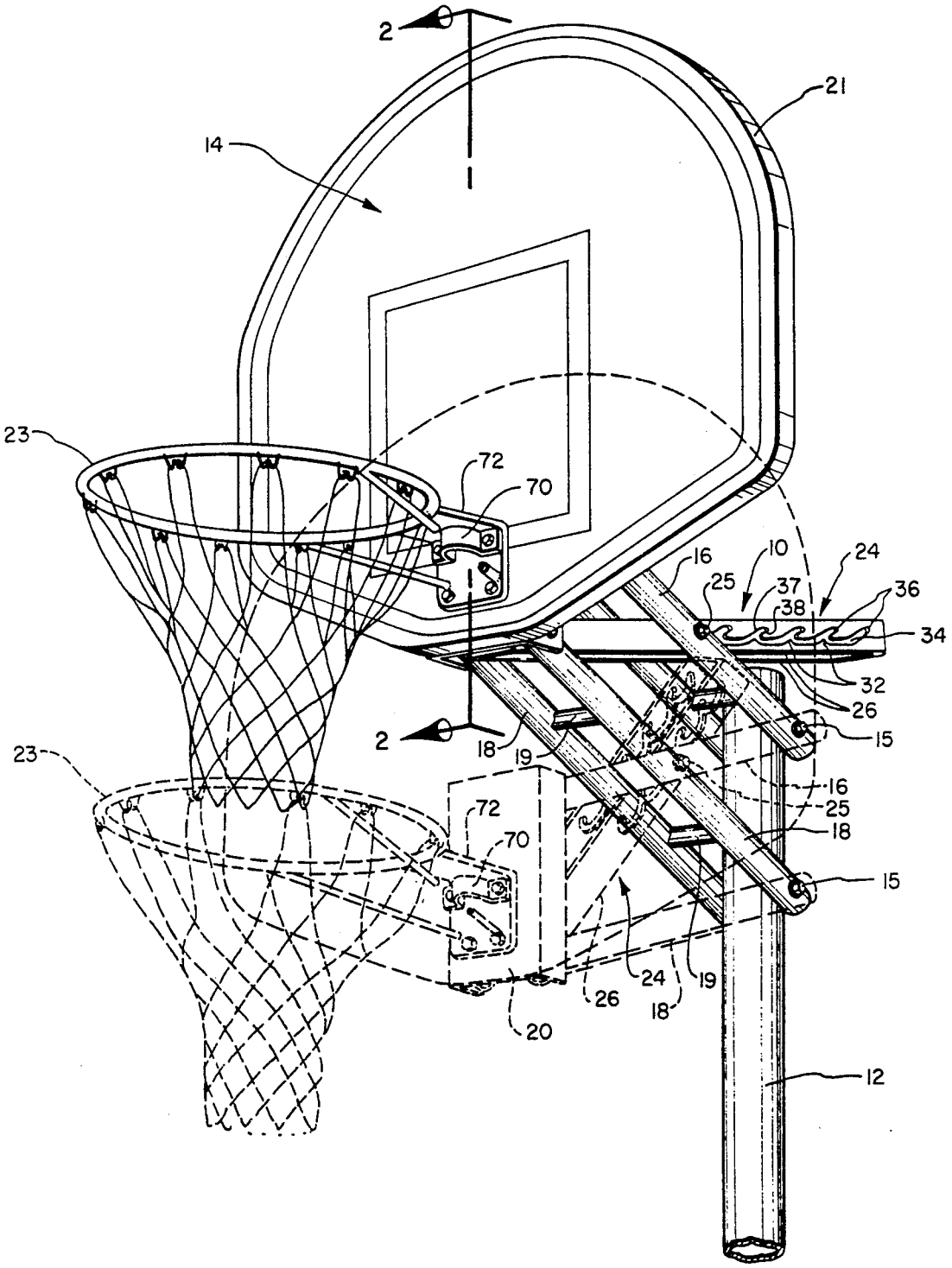
FIG. 1 is a perspective view of a parallelogrammatic structure utilizing the present invention and having a basketball goal mounted thereon and disposed so that the basketball goal is at its highest usable position. The phantom lines show the structure of the present invention as it would appear in its lowered position.

Reference is now made to the figures wherein like parts are referenced by like numerals throughout. With particular reference to FIG. 1, an adjustable support system of the present invention is generally designated 10. The adjustable support system 10 comprises a deformable parallelogrammatic structure which is pivotally connected to a rigid support 12 on one side of the structure and to a conventional basketball goal 14 on the other side. As shown in FIG. 1, the adjustable support system 10 may be connected directly to the rigid support 12 by means of hinge pins 15. The adjustable support system 10 may be connected to the rigid support 12 by any of several methods, which are more fully discussed below, so long as the adjustable support system 10 is pivotally connected to the rigid support 12.

Figure 2:
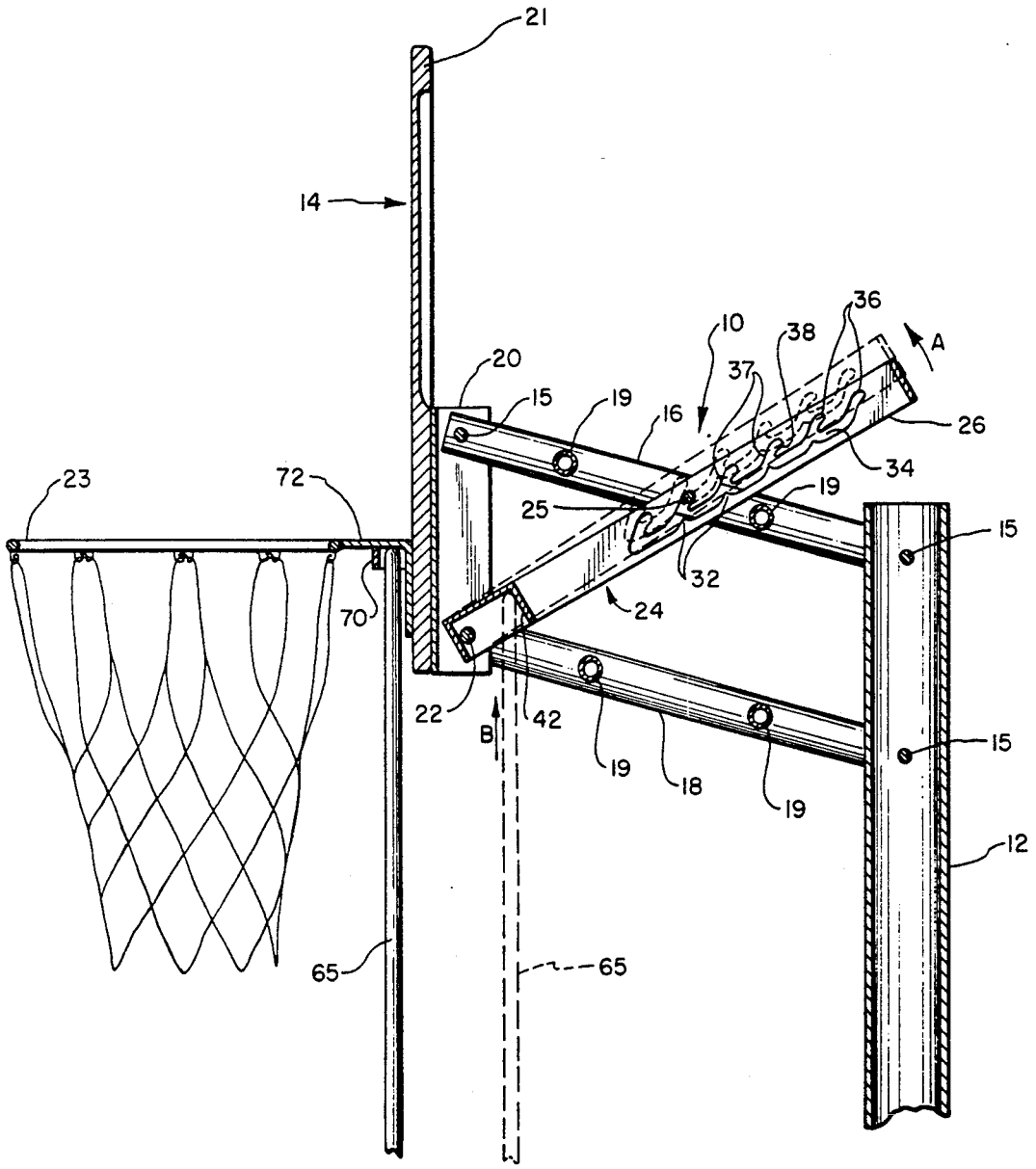
FIG. 2 is a cross-sectional view taken along line 2—2 of FIG. 1.

The adjustable support system 10 comprises an upper support 16, and a lower support 18. The upper and lower supports 16 and 18 may be comprised of two spaced structural pieces. The two structural pieces may be braced by means of bracing members 19. It will be appreciated that these structural members may comprise any configuration sufficient to satisfy the structural limitations necessitated by the present invention. As seen in FIG. 2, hinge pins 15 are used to pivotally mount the upper support 16 and the lower support 18 to a mounting plate 20 on one end and to the rigid support 12 at the other end. Upper support 16 and lower support 18 must be mounted so that they remain substantially parallel to each other as they pivot, changing the general configuration of the parallelogram defined by the rigid support 12, the upper support 16, the lower support 18 and the mounting plate 20. In this manner, as the configuration of the so-defined parallelogram changes with the raising or lowering of the mounting plate 20, the configuration remains a parallelogram and the mounting plate 20 remains vertically disposed because the rigid support 12 is vertically disposed.

Although the presently preferred embodiment of the present invention employs the use of mounting plate 20, the upper support 16 and lower support 18 may be mounted directly to the basketball goal 14. Instead of mounting the basketball goal 14 directly to the rigid support 12, as would be done in the absence of the present invention, for ease of construction, the basketball goal 14 is mounted to the mounting plate 20. The basketball goal 14 may be of the type conventionally known in the art, comprising a backboard 21 and a rim or hoop 23.

The adjustable support system 10 further comprises an adjustable support brace 24 which is pivotally connected by a pivot pin 22 to the so-defined parallelogram. The opposite end of the support brace 24 is free-moving as the support brace 24 is slidably connected to a post 25 which, in turn, is mounted to the parallelogrammatic structure at a point substantially opposite the pivot pin 22 on a nonadjacent side of the parallelogrammatic structure, as will be explained in further detail below. It is preferred that the support brace 24 be pivotally connected at a vertex of the parallelogrammatic structure. It will be appreciated that the support brace 24 may be pivotally connected to the parallelogrammatic structure at points other than the vertexes and that the post 25 may be positioned on the parallelogrammatic structure at any one of several points. One advantage, however, of pivotally connecting the support brace 24 to the parallelogrammatic structure at a vertex is that the pivot pin 22 may also function as a hinge pin 15 thereby eliminating extra parts and facilitating manufacture. It is only necessary that the support brace 24 be mounted at a sufficient angle from the vertical that the force of gravity may sufficiently act on the system to urge the support brace 24 against the post 25, as will be explained below in further detail.

As illustrated in the drawings, it is presently preferred that the support brace 24 be pivotally mounted to the parallelogrammatic structure at the vertex where the lower support 18 is connected to the mounting plate 20. It is also presently preferred that the opposite end of the support brace 24 engage the post 25 mounted to the upper support 16 offset a short distance from the center of the upper support 16 towards the rigid support 12. This configuration is designed to maximize the effect of the force of gravity on the system while keeping to a minimum the amount of stress on the support brace 24. It will be appreciated by one skilled in the art that the adjustable support system 10 may function with the support brace 24 mounted at different positions along the parallelogrammatic structure. However, it is presently believed that the configuration illustrated in FIG. 2 is the most efficient configuration for accomplishing the objectives of the present invention.

Still referring to FIG. 2, the different components which comprise the support brace 24 will be explained. In the presently preferred embodiment of the invention, the support brace 24, as described above, is pivotally mounted at one end to the vertex formed in the parallelogrammatic structure by the intersection of the mounting plate 20 and the lower support 18. The support brace 24 comprises two parallel arms 26, each configured with a slot 34 which extends substantially longitudinally along the parallel arms 26. A plurality of notches 36 are provided spaced along one side of each slot 34.

The post 25 is secured between parallel bars which form the upper support 16. While the post 25 may be secured to either of the sides of the parallelogrammatic structure which are not adjacent to the vertex at which the support arm 24 is pivotally mounted, i.e. the upper support 16 or the rigid support 12, preferably the post 25 is secured to upper support 16 at a point between the midpoint of upper support 16 and the intersection of the upper support 16 and the rigid support 12. It is disadvantageous to affix the post 25 too close to the rigid support 12 because the rigid support 12 will interfere with the operation of the adjustable support system 10, requiring modification of the rigid support 12 if the adjustable support system 10 is to operate properly. When assembled, the post 25 is disposed within the slots 34 in the parallel arms 26.

The support brace 24 acts as a brace which binds the parallelogrammatic structure when the post 25 engages one of the notches 36, the post 25, thereby "locking" the basketball goal 14 at a fixed, predetermined height. As the basketball goal 14 is raised, the parallelogrammatic structure is deformed such that the distance between the pivot pin 22 and the post 25 is decreased. Thus, the slot 34 in the arm 26 should be of sufficient length to allow the basketball goal 14 to be adjusted to several different heights, as desired.

As illustrated in FIG. 2, the notches 36 in the side of the slot 34 should be configured to have a bevelled side 37 and a stop side 38. The stop side 38 is substantially perpendicular to the support brace 24 or may have a slightly concave curvature so that when a downward force (e.g., gravity) is applied to the basketball goal 14 placing tension on the support brace 24, the post 25 engages the stop side 38 of one of the notches 36 and rests there which prevents the parallelogrammatic structure from deforming further. The bevelled side 37 of each notch 36 is configured so that when an upward force is applied to the basketball goal 14, a compression force is applied to the support brace 24, which causes the post 25 to be pushed against and advanced along the bevelled side 37 of the notch 36. As the post 25 exits the notch 36, it aligns with the slot 34 in slidable engagement thereby permitting the parallelogrammatic structure to be deformed.

The side of the slot 34 opposite the notches 36 preferably is configured to have several guiding teeth 32. Each notch 36 is aligned with a guiding tooth 32. The guiding teeth 32 act as a safety mechanism. In the event the adjustable support system 10 slips or is dropped as it is being adjusted, as the basketball goal 14 begins to fall, the guiding tooth 32 which is aligned with the post 25 will guide the support brace 24 such that the notch 36 corresponding to the guiding tooth 32 will engage the post 25, thereby preventing the basketball goal 14 from falling to a lower position.

The support brace 24 is provided with a release cup 42. A force may be applied to the support brace 24 at the release cup 42 to initiate pivoting movement of the support brace 24 about the pivot pin 22 which releases the post 25 from the notch 36 it occupies. When the support brace 24 pivots sufficiently to position the post 25 in the slot 34, the basketball goal 14 may be raised or lowered as the post 25 freely slides within the slot 34.

As can be seen by reference to FIG. 2, the release cup 42 is formed in the support brace 24 such that it is protected from inadvertent engagement at all times. The release cup 42 is shielded by the backboard 21 and the lower bracing member 18. Thus, the release cup 42 may not be depressed by an errant basketball. This is in contrast to many prior art apparatus wherein the release mechanism may be actuated by the inadvertent or intentional striking with a basketball.

A counterbalance spring (not shown) may be provided which extends substantially between the pivot pin 22 and the hinge pin 15 at the opposite vertex of the parallelogrammatic structure. The counterbalance spring reduces the force which must be applied to the basketball goal 14 in order to alter the shape of the parallelogrammatic structure thereby adjusting the height of the basketball goal 14.

Figure 3:
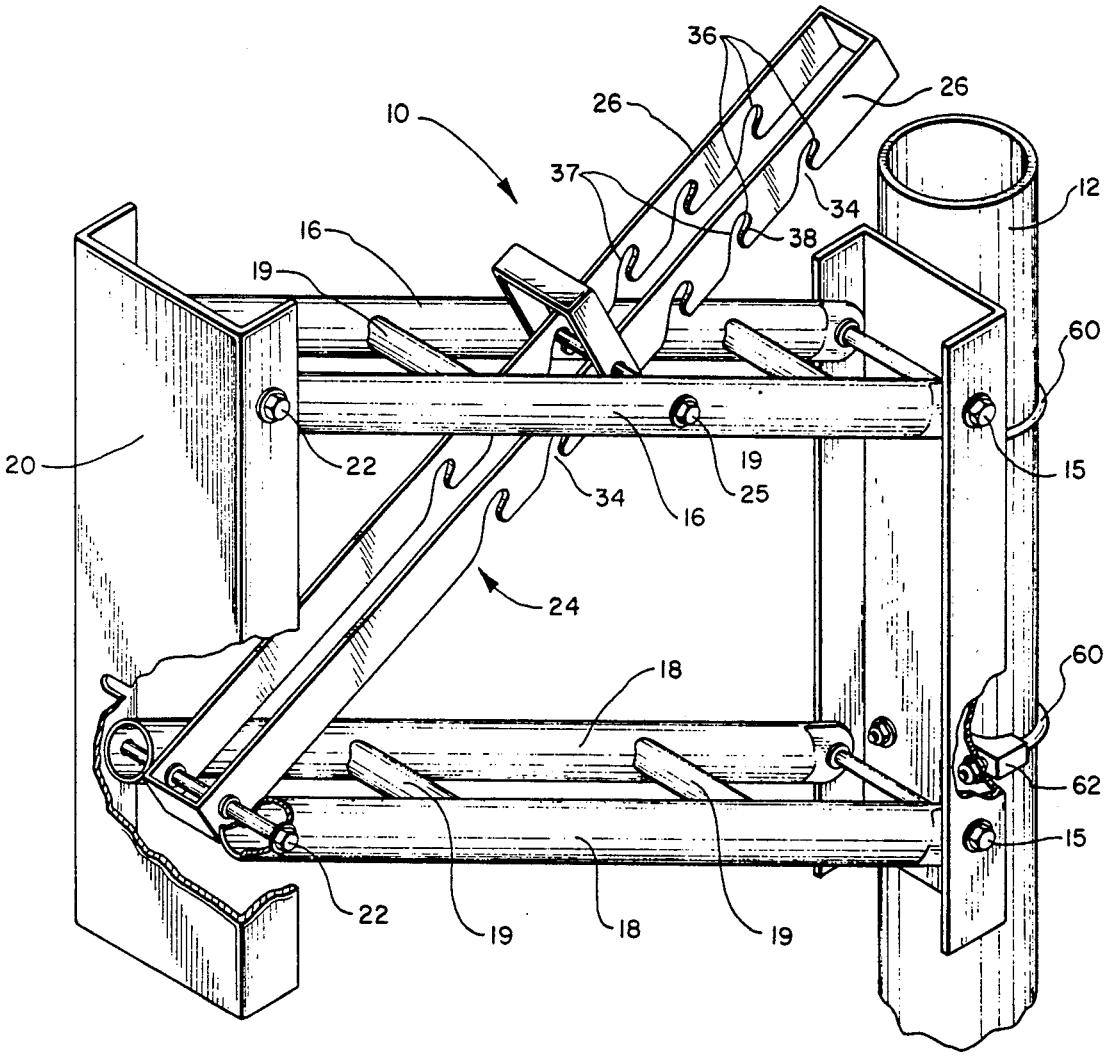
FIG. 3 is a perspective view of an alternative embodiment of the present invention.

FIG. 3 illustrates an alternative embodiment of the present invention. Rather than employing a slot 34 and notch 36 which is completely internal to the parallel arm 26, the embodiment shown in FIG. 3 employs a slot 34 which is "open." The embodiment shown in FIG. 3 operates in substantially the same fashion as the embodiment illustrated in FIGS. 1 and 2. When the release cup 42 is depressed, that force is transferred through the support brace 24 to the parallelogrammatic structure by a restraining bracket 40. Thus, as the support brace 24 is pivoted about the pivot pin 22, the restraining bracket 40 acts to restrain the support brace 24 from pivoting more than necessary.

Although the apparatus shown in the figures shows the basketball goal 14 as it might be newly constructed, the present invention may also be retrofit to an existing basketball pole. This can be done in at least two ways. First, as shown best in FIG. 1, the upper support 16 and the lower support 18 may be pivotally mounted by means of hinge pins 15 to the existing pole. Alternatively, as shown in FIG. 3, the upper support 16 and the lower support 18 may be pivotally mounted to a rigid support plate 58 which is in turn secured to the existing pole by means of U-bolts 60 and a saddle clamp 62 or any other method commonly known by which the rigid support plate 58 may be rigidly secured to an existing pole. The rigid support plate 58 provides an additional advantage in that it can be used to correct an improperly installed basketball pole. It is not uncommon for a basketball pole to be installed, particularly when a non-adjustable goal is used, where the pole is set too deep or it is turned such that the backboard 21 does not squarely address the playing area. With the rigid support plate 58, the basketball goal 14 can be raised or lowered with respect to the pole 12 by minute increments. Also, the angle at which the backboard 21 addresses the playing area may be adjusted. A further advantage of the rigid support plate 58 is that it can also be used to mount the present invention against a wall or other permanent wall-like structure. Thus, the present invention is not limited to use with a pole. If the present invention is mounted against a wall, care must be taken to affix the support brace 24 to the parallelogrammatic structure such that the wall does not inhibit the adjustment of the adjustable support system 10 by interfering with the support brace 24.

Operation of the present invention is quick and easy. The method employed to adjust the present invention depends on whether it is desired to raise or lower the basketball goal 14. To raise the height of the basketball goal 14, an upward force sufficient to overcome gravity and minor frictional resistance is applied to the basketball goal 14 with a long rod 65, or similar implement. It should be appreciated that the force which must be applied to raise the basketball goal 14 may be applied at virtually any point on the basketball goal 14 or the adjustable support system 10. However, the greater the horizontal distance between where the force is applied and where the upper support 16 and the lower support 18 are pivotally mounted to the rigid support 12, the lesser the force required to raise the basketball goal 14. For this purpose, it is preferred that a guide loop 70 is positioned on the underside of the brace portion 72 of the basketball rim 23, as shown in FIG. 1. This guide loop 70 provides a holder for the end of the rod 65 used to apply the upward force to the basketball goal 14. The guide loop 70 holds the end of the rod 65 to prevent slipping so that the force is applied to the desired area.

With the preferred embodiment of this invention, raising the goal 14 causes the parallelogrammatic structure to deform such that the distance between the pivot pin 22 and the post 25 decreases. As the parallelogrammatic structure is deformed in this manner, the bevelled side 37 of whichever notch 36 is positioned within the post 25 is forced against the post. As this force overcomes the forces acting to urge the support brace 24 against the post 25, the support brace 24 pivots slightly in the direction of arrow A, as illustrated in FIG. 2. The post 25 is disengaged from the notch 36 and is advanced within the slot 34 to the next notch 36 which is then engaged by the post 25 due to forces acting on the system. A continued upward force causing further deformation of the parallelogrammatic structure causes the post 25 to be disengaged from the notch 36, advance along the slot 34, and engage the next adjacent notch 36, until the desired height of the basketball goal 14 is obtained.

To lower the height of the basketball goal 14, the long rod 65 is used to engage and depress the release cup 42. As a sufficient force is applied to the release cup 42 by pushing it in the direction shown by arrow B, as illustrated in FIG. 2, the support brace 24 pivots slightly about pivot pin 22 in the direction of Arrow A. The pivoting movement of the support brace 24 disengages the post 25 from the notch 36 and places the post 25 within the slot 34 of the support brace 24, as can be seen by reference to the phantom lines in FIG. 2. In this position, the support brace 24 is free to slide with respect to the post 25 as the parallelogrammatic structure is deformed without the post 25 engaging any notches 36.

When the support brace 24 is pivoted to the position illustrated by the phantom lines in FIG. 2, the basketball goal 14 may freely be lowered to the desired height. This is done by lowering the rod 65 while ensuring that the release cup 42 remains depressed. If the rod 65 is quickly removed from contact with the release cup 42 before the basketball goal 14 has been fully lowered, the support brace 24 pivots in a direction opposite to that shown in Arrow A, causing one of the notches 36 to engage the post 25. In the embodiment of the present invention illustrated in FIGS. 1 and 2, the notch 36 is also guided into engagement with the post 25 by a guide tooth 32. This halts the continued descent of the basketball goal 14 thereby preventing injury to those using the goal in the event the rod 65 is removed from the release cup 42 while the adjustable support system 10 is being adjusted. Thus, in lowering the goal 14 to a desired position, the rod 65 can be quickly removed from the release cup 42 when the goal 14 is just above the desired height. The support brace 24 then pivots back to its engaged position, thereby returning a notch 36 for secure engagement with the post 25 without allowing the goal 14 to drop to a lower height.

An alternative and preferred method for lowering the height of the basketball goal 14 involves depressing the release cup 42 so that the notch 36 disengages the post 25, thereby positioning the post 25 in the slot 34. The goal 14 is then lowered to the lowest height permitted by the support brace 24 where the rod 65 used to depress the release cup 42 can be removed. The goal 14 is then raised to the desired height in the manner described above.

An alternative and less desirable method for raising the basketball goal 14 may be accomplished by depressing release cup 42 with a stick or a pole as is described above for lowering the basketball goal 14. As the release cup 42 is depressed, the resultant pivoting movement of the support brace 24 frees the post 25 from the notch 36. A continued upward lifting force on the release cup 42 advances the support brace 24 with respect to the post 25. As the post 25 aligns with the notch 36 corresponding to the desired height of the basketball goal 14, the rod 65 is quickly removed from the release cup 42 and the force of gravity will cause pivoting movement of the support brace 24 thereby positioning the post 25 in secure engagement with a notch 36 before the basketball goal 14 falls to a lower position. If the post 25 does not engage the desired notch 36, it will merely slide along the slot 34 as the parallelogrammatic structure continues to deform until it engages the next notch 36. In no case will the present invention allow the basketball goal 14 to fall more than the height corresponding to the movement of the post 25 from one notch 36 to the next notch 36.

Although the present invention is shown as used with a basketball goal 14, as illustrated in FIGS. 1 and 2, it will be appreciated that the present invention may be used in any application such as volleyball nets, etc. wherein it is desired to adjust the height of an object to predetermined heights when to do so presents at least some of the problems the present invention is designed to overcome.

From the foregoing, it will be appreciated that the present invention provides a method and apparatus for quickly and safely adjusting a basketball goal or other object while avoiding the problems inherent in other adjustable basketball standards. The present invention avoids the significant safety hazards encountered by others, such as the possibility that the basketball goal may fall to its lowest position when the basketball is dunked. The present invention may be adjusted to various predetermined heights without having to perform complicated or dangerous maneuvers and adjustments may be accomplished without the use of a ladder or similar device.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An adjustable basketball goal system allowing for adjustment of the height of a basketball goal above a playing surface, comprising:

a deformable parallelogrammatic structure, said parallelogrammatic structure being deformable into a plurality of configurations wherein at each configuration the basketball goal is disposed at a different height above the playing surface;

a post connected to said parallelogrammatic structure;

means for securing said deformable parallelogrammatic structure to a rigid object such that said parallelogrammatic structure is suspended above the playing surface;

means for attaching the basketball goal to said parallelogrammatic structure;

at least one support brace having a pivotal axis at one end by which it is pivotally connected to said parallelogrammatic structure and said support brace slidably engaging said post such that said support brace pivots about said pivotal axis in a vertical plane between a first position and a second, lower position, said support brace being configured such that said support brace will move from said first position, to said second position when acted upon solely by the force of gravity, said support brace including a slot having a plurality of notches such that when said support brace is in said first position, said post engages said slot thereby allowing said parallelogrammatic structure to be deformed to any of the configurations, and such that when said support brace is in said second position said post engages one of said notches thereby securing said parallelogrammatic structure into one of the configurations; and a release cup configured such that a force may be applied to the release cup to support the effective weight of the goal and to move said support brace from said second position to said first position.

2. An adjustable basketball goal system as set forth in claim 1 wherein said pivotal axis is disposed at one of the vertexes of said parallelogrammatic structure.

3. An adjustable basketball goal system as set forth in claim 2 wherein said post is connected to said parallelogrammatic structure at a location spaced from the vertex on a nonadjacent side of said parallelogrammatic structure.

4. An adjustable basketball goal system as defined in claim 1 wherein said notches are spaced along said slot at predetermined intervals which correspond to predetermined desired configurations for said parallelogrammatic structure.

5. An adjustable basketball goal system as set forth in claim 1 further comprising guiding means for guiding said support brace from said first position to said second position such that said locking means may secure said parallelogrammatic structure into one of the configurations.

6. An adjustable basketball goal system as defined in claim 1 wherein each of said notches has a bevelled side for directing said post when a force is applied to the structure which tends to deform said parallelogrammatic structure such that the basketball goal is raised, said post engages the bevelled side of said notch and is directed under the force applied along said bevelled side to engage said slot thereby moving said support brace from said second position to said first position.

7. An adjustable basketball goal system as set forth in claim 1 further comprising a guide loop in connection with the goal for receiving the tip of a force-applying implement and for restraining the tip of the implement from advertent slippage such that a force may be applied to the goal.

8. A method for lowering the height of a basketball goal connected to a deformable parallelogrammatic structure from a first predetermined height to a second, lower predetermined height, the parallelogrammatic structure having a support brace including a pivotal axis by which the support brace is pivotally connected to the parallelogrammatic structure, the support brace including a longitudinal slot with a plurality of notches wherein each notch has a bevelled side, the slot disposed about a post in connection with the parallelogrammatic structure wherein the support brace pivots about the pivotal axis in a vertical plane between a first position such that the post engages the slot thereby allowing the parallelogrammatic structure to be deformed and a second position such that the post engages one of the notches thereby securing the parallelogrammatic structure from deformation, the support brace being configured such that it will move from the first position to the second position when acted upon solely by the force of gravity, the support brace further including a release cup configured to receive the end of an elongated implemented and to restrain the end of the implement from inadvertent slippage as the implement is used to depress the release cup, the release cup being further configured such that when a sufficient force is applied to the release cup, the release cup supports the effective weight of the goal and causes the support brace to move from the second position to the first position, the method comprising the steps of:

applying force to the release cup to support the weight of the goal and to pivot the support brace about its pivotal axis from the second position wherein the post engages one of the notches to the first position wherein the post is disengaged from the notches and is disposed for slidable movement along the length of the slot thereby permitting the parallelogrammatic structure to deform;

altering the shape of the parallelogrammatic structure by lowering the basketball goal to its lowest position thereby causing the post to slide along the full length of the slot to align with and engage the notch corresponding to the lowest predetermined height for the basketball goal;

engaging the basketball goal with the tip of the implement used for applying force to the basketball goal thereby resulting in a force being applied to the parallelogrammatic structure such that the resultant force on the parallelogrammatic structure tends to alter the shape of the parallelogrammatic structure thereby pressing the bevelled side of the notch against the post and causing the support brace to pivot from the second position wherein the post is positioned within one of the notches to the first position whereby the post is disengaged from the notches and is disposed for slidable movement along the length of the slot thereby permitting the parallelogrammatic structure to be deformed;

moving the basketball goal to the second predetermined height by continuing to apply a force to the parallelogrammatic structure such that the post slidably travels the slot to a position wherein the post aligns with a notch corresponding to the second predetermined height; and releasing the force being applied to the parallelogrammatic structure such that the force of gravity causes the support brace to pivot from the first position to the second position such that the post engages the notch corresponding to the second predetermined height.

9. A method for altering the height of a basketball goal secured to a deformable parallelogrammatic structure, the parallelogrammatic structure having at least one support brace in connection therewith, the support brace having a pivotal axis by which it is pivotally connected to the parallelogrammatic structure, the support brace comprising locking means for securing said parallelogrammatic structure, the support brace being configured such that it pivots about the pivotal axis in a vertical plane between an engaged position wherein the locking means secures the parallelogrammatic structure and a disengaged position wherein the locking means allows the parallelogrammatic structure to be deformed, the support brace being further configured such that it will move from the disengaged position to the engaged position when acted upon solely by the force of gravity, the support brace further including a release cup configured to receive the end of an elongated implemented and to restrain the end of the implement from inadvertent slippage as the implement is used to depress the release cup, the release cup being further configured such that when a sufficient force is applied to the release cup, the release cup supports the effective weight of the goal and causes the support brace to move from the second position to the first position, the method comprising the steps of:

applying force to the release cup to support the weight of the goal and to pivot the support brace about its pivotal axis from the engaged position to the disengaged position whereby the parallelogrammatic structure is permitted to deform its shape;

changing the height of the basketball goal thereby changing the shape of the deformable parallelogrammatic structure from a first configuration to a second configuration; and removing the force from the support brace thereby allowing the support brace to return to the engaged position thereby restricting further substantial movement of the parallelogrammatic structure.

10. An adjustable basketball goal system allowing for adjustment of the height of a basketball goal above a playing surface, comprising:

a deformable parallelogrammatic structure, said parallelogrammatic structure being deformable into a plurality of configurations wherein at each configuration the basketball goal is disposed at a different height above the playing surface;

means for securing said deformable parallelogrammatic structure to a rigid object such that said parallelogrammatic structure is suspended above the playing surface;

means for attaching the basketball goal to said parallelogrammatic structure;

a support configured to operate between an engaged position and a disengaged position, said support being in mechanical communication with the deformable parallelogrammatic structure; and receiving means in mechanical communication with said support, and forming a structure distinct from the support, for receiving the end of a force applying implement and for restraining the end of the implement from inadvertent slippage as the implement is used to apply a force to the basketball goal system.

11. An adjustable basketball goal system allowing for adjustment of the height of a basketball goal above a playing surface, comprising:

a deformable parallelogrammatic structure, said parallelogrammatic structure being deformable into a plurality of configurations wherein at each configuration the basketball goal is disposed at a different height above the playing surface;

means for securing said deformable parallelogrammatic structure to a rigid object such that said parallelogrammatic structure is suspended above the playing surface;

means for attaching the basketball goal to said parallelogrammatic structure;

a support configured to operate between an engaged position and a disengaged position, said support being in mechanical communication with the deformable parallelogrammatic structure; and receiving means in mechanical communication with said support for receiving the end of a force applying implement and for restraining the end of the implement from inadvertent slippage as the implement is used to apply a force to the basketball goal system, the receiving means configured such that when a sufficient force is applied to the receiving means, the receiving means supports the effective weight of the goal and causes the support to move from the engaged position to the disengaged position, such that the height of the basketball goal may be adjusted.

12. An adjustable basketball goal system allowing for adjustment of the height of a basketball goal above a playing surface as defined in claim 11 wherein said support comprises restricting means for restricting the deformation of the parallelogrammatic structure at any one of a plurality of configurations such that the basketball goal is suspended above a playing surface at one of a plurality of heights.

13. An adjustable basketball goal system allowing for adjustment of the height of a basketball goal above a playing surface as defined in claim 12 wherein said restricting means comprises at least one support brace having a pivotal axis by which said support brace is pivotally connected to said parallelogrammatic structure, said support brace being configured to pivot about said pivotal axis in a vertical plane between a first position and a second, lower position.

14. An adjustable basketball goal system allowing for adjustment of the height of a basketball goal above a playing surface as defined in claim 13 wherein said support brace further comprises locking means for securing said parallelogrammatic structure, said locking means having both engaged and disengaged positions.

15. An adjustable basketball goal system allowing for adjustment of the height of a basketball goal above a playing surface as defined in claim 14 further comprising a post connected to said parallelogrammatic structure, such that said locking means is slidably connected to said post.

16. An adjustable basketball goal system allowing for adjustment of the height of a basketball goal above a playing surface as defined in claim 13 further comprising guide means for guiding said support brace from said first position to said second position such that said locking means may secure said parallelogrammatic structure into one of the configurations.

17. An adjustable basketball goal system allowing for adjustment of the height of a basketball goal above a playing surface as defined in claim 11 further comprising a guide loop in connection with the goal for receiving the tip of a force-applying implement and for restraining the tip of the implement from inadvertent slippage such that a force may be applied to the goal.

* * * * *